US005873697A

United States Patent [19]

Gully

[11] Patent Number: 5,873,697

[45] **Date of Patent: *Feb. 23, 1999**

[54] METHOD OF IMPROVING CENTRIFUGAL PUMP EFFICIENCY

[75] Inventor: James B. Gully, Moss Point, Miss.

[73] Assignee: Chevron U.S.A., Inc., San Francisco, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 555,677

[22] Filed: Nov. 13, 1995

Related U.S. Application Data

[63] Continuation-in-part of Ser. No. 321,531, Oct. 11, 1994, abandoned.

[51] Int. Cl.[6] ..... F04D 29/16

[52] U.S. Cl. ..... 415/172.1; 415/170.1; 415/174.2; 415/106; 29/402.02; 29/888.021; 29/889.1

[58] Field of Search ..... 415/104, 106, 415/107, 170.1, 172.1, 174.2, 174.4, 173.6; 416/174, 181, 231 R, 224; 277/26, DIG. 6; 29/402.02, 888.021, 889.1, 898.01, 898.07, 898.11, 898.15

[56] References Cited

U.S. PATENT DOCUMENTS

| | | | |
|---|---|---|---|
| 2,465,930 | 3/1949 | Robinson | 415/172.1 |
| 3,664,759 | 5/1972 | Bibeller . | |
| 3,723,019 | 3/1973 | Berman . | |
| 3,841,791 | 10/1974 | Doolin . | |
| 3,910,715 | 10/1975 | Yedidiah . | |
| 4,037,985 | 7/1977 | Karassik et al. . | |
| 4,111,597 | 9/1978 | Grossi et al. . | |
| 4,224,675 | 9/1980 | Bower . | |
| 4,890,980 | 1/1990 | Heald et al. . | |
| 5,005,990 | 4/1991 | Wotring . | |
| 5,248,245 | 9/1993 | Behnke et al. | 415/170.1 |
| 5,368,312 | 11/1994 | Voit et al. | 277/26 |

FOREIGN PATENT DOCUMENTS

| | | | |
|---|---|---|---|
| 0150460 | 9/1920 | United Kingdom | 415/174.4 |

*Primary Examiner*—Christopher Verdier
*Attorney, Agent, or Firm*—Burns, Doane, Swecker & Mathis, L.L.P.

[57] ABSTRACT

The method includes replacing conventional wear rings between a centrifugal pump casing inlet and the rotatable impeller having a plurality of circumferentially spaced blades. A substitute wear ring is formed of a thermoplastic polymer, POLY-ETHER-ETHER-KETONE (PEEK) which is thermally stable and self lubricating over a range of temperatures of from zero to 600° F. Because the thermal coefficient of expansion of PEEK is substantially different from the pump casing metal and the impelled metal, the use of the PEEK allows the efficiency of the pump to be increased by correctly calculating the diameters for construction of the wear ring for operation over a selected range of temperatures of the pumped fluid. The process reduces the clearance between the surfaces of the three elements to substantially improve pump efficiency while at the same time vibration and wear are reduced substantially.

11 Claims, 4 Drawing Sheets

METHOD OF IMPROVING CENTRIFUGAL PUMP EFFICIENCY

This is a continuation in part of application Ser. No. 08/321,531 filed Oct. 11, 1994, now abandoned.

The present invention relates to centrifugal pumps. More particularly, it relates to a method for modifying wear rings and bushings in centrifugal pumps operating at temperatures ranging from zero to 600° F. Such method makes possible retrofitting centrifugal pumps with wear rings and bushings made of thermoplastic Poly-Ether-Ether-Ketone, "PEEK". Because of its thermal stability over such temperatures and its self lubricating nature, PEEK makes it possible to run much closer clearances between the impeller intake and the pump casing, improving hydraulic performance and reducing energy-wasting recirculation. The method also substantially reduces internal damage from mishaps in the pump.

If desired, PEEK additionally increases the life efficiency and reliability by plugging impeller balance holes. This not only reduces recirculation, but also increases seal chamber pressure to prolong seal life. The method is believed to cover a higher percentage of all centrifugal pumping applications.

In accordance with the invention, modifications consist of (1) using PEEK thermoplastic instead of conventional metals for wear rings and bushings and optionally (2) plugging impeller balance holes on single stage pumps. The use of PEEK improves pump efficiency and performance through the use of closer running clearances. Plugging impeller balance holes provides similar benefits by further reducing internal recirculation. The combination of closer clearance and the unique properties of PEEK reduce vibration and dramatically decrease repair cost and time when a mishap has occurred.

PEEK is a high performance thermoplastic that has both high strength and high temperature limits, e.g. up to 600° F. It has been used as the premier material for sealing elements in compressor valves and has been widely applied in pumps, as well as other compressor applications, but has not heretofore been used as wear rings or plugging material for balance holes.

In its most fundamental form, the method of the invention permits removal of O.E.M. wear rings in centrifugal pumps and, by employing my method, substitution of a PEEK ring on the pump impeller is sufficient to improve substantially the efficiency and pumping capacity. Additionally in many situations, the pump casing can be left in place in the field and only the impeller will need such modifications.

Further, in accordance with my invention, two important considerations must be observed for such wear ring.

1. PEEK expands at a much greater rate than metals. This means that as operating temperatures increase, the interference fit between the impeller and the wear rings loosens.
2. Differential pressure on the opposing sides of the ring work to push the wear ring off the impeller toward the suction eye.

To account for the greater expansion of the PEEK wear ring, a heavy initial "cold" (ambient temperature) interference fit is used, and the upper temperature limits for the pumped fluid must be specified. I have found that the initial interference fit used is 0.004" per inch of diameter. The upper temperature limit is based on a minimum "hot" (operating temperature) interference fit of 0.002" per inch of diameter. It is to be particularly noted that this temperature limit is different for different impeller metals because some expand at a greater rate than others. This "hot" interference fit of 0.002" per inch has proved to be reasonable. Where a looser "hot" interference fit is satisfactory, temperature limits can be increased.

For PEEK wear rings installed in a pump casing or other "shrink-in" applications, the temperature limit is 300° F. As discussed above, the limit for PEEK wear rings installed on impellers and for other "shrink-on" applications are determined by the relative expansion rates. Maximum operating temperatures for PEEK wear rings installed on impellers are given below.

In general, PEEK has excellent chemical resistance and may be used for pumping numerous hydrocarbons from crude oil to propane. It is also suitable for condensates, boiler feed water, sour water and a wide variety of other dirty water services. Other services include ammonia, caustic, DEA and carbonate. However, PEEK wear rings are not suitable in pumping sulfuric acid, nitric acid, HF acid, or chlorine.

The present method additionally compensates for operations mishaps. Such mishaps as loss of suction and running "blocked-in" frequently result in heavy rubbing between rotating and stationary parts. With conventional metals against metals, very high temperatures can be generated quickly and can cause severe damage to centrifugal pump components. When metal galling occurs, the damage can be even more extensive. Multi-stage pump casings can suffer distortions and loss of metal that require very expensive and time-consuming metal build-up, milling and boring. Where PEEK wear rings and bushings have been used, pumps that experience the same operational upsets can be repaired at a fraction of the cost and in a fraction of the time.

In addition to the above, there are other ways that maintenance and down times can be reduced. Closer running clearance reduces vibration, which can in turn extend component life. Plugging balance holes in an impeller can increase seal life by raising seal chamber pressure. Eliminating balance holes can also lengthen bearing life by applying steady unidirectional axial loading.

Efficiency improvements are realized in three distinct areas:

1. Wear ring clearances are reduced to 50% of the former "as new" clearances.
2. Plugging impeller balance holes decreases the total internal recirculation to 50% of what it would be with two impeller wear rings.
3. In services where process conditions have permanent changes such as substantially different temperatures of pumped fluid, different impellers can be installed to enable normal operation at or closer to the best efficiency point.

Further objectives and advantages of the present invention will become apparent from the following description of the preferred embodiments taken with the drawings which form an integral part of this specification.

Figure 1:
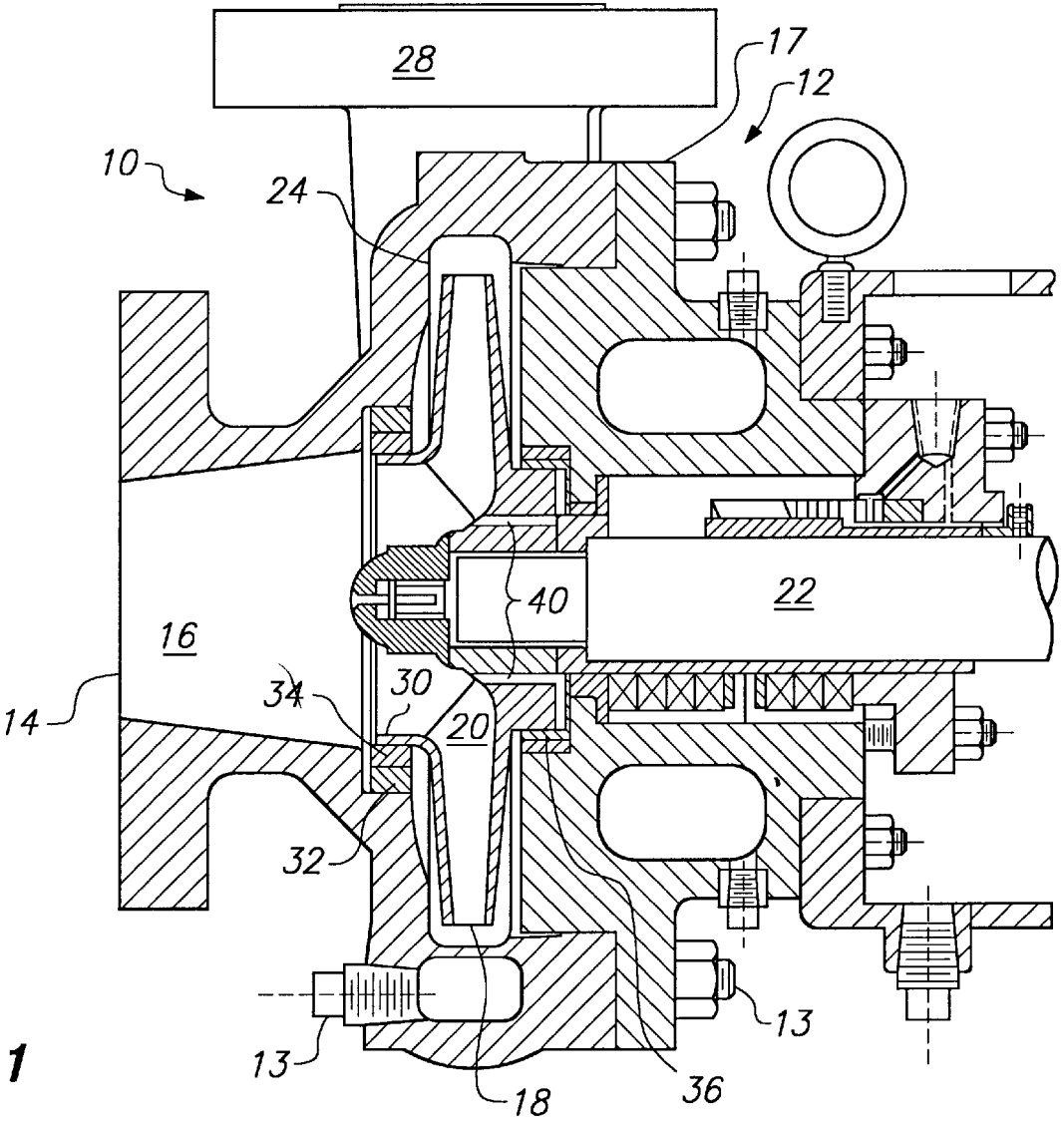
FIG. 1 is a partial cross-sectional elevation view of a single stage centrifugal pump which illustrates modification of the wear ring between the intake casing wall and the rotating impeller. It also indicates plugging of the balance hole of the impeller.

Referring now to the drawings and particularly as to FIG. 1, a typical single stage centrifugal pump 10 is shown in partial cross-section. As there seen, casing 12 includes an intake section 14 which feeds liquid into chamber 16 for delivery to impeller 18. Impeller 18 includes a plurality of vanes 20 which are circumferentially spaced apart. Impeller 18 is mounted on the end of drive shaft 22 which is driven by an external electric motor, diesel engine or the like (not shown). Chamber 24, around impeller 18 delivers fluid pumped by vanes 20 to an outlet chamber 28 supported by intake section 14 of casing 12. As shown, intake section 14 and rear section 17 are clamped together, as by bolts 13 to form chamber 24.

It will be seen that pressure in output chamber 28 is substantially higher that at inlet 16. Such pressure depends upon speed of the vanes and efficient sealing between the outer diameter at inlet end 30 of impeller 18. As shown, a wear ring 32 and packing bushing 34 form a circumferential seal between impeller 18 and casing 12. As also shown, the driven end of impeller 18 also normally includes a rear wear ring 36 which controls flow of a portion of the intake fluid which enters through balance holes 40. As discussed below, when balance holes 40 are closed, wear ring 36 may be eliminated.

Figure 2:
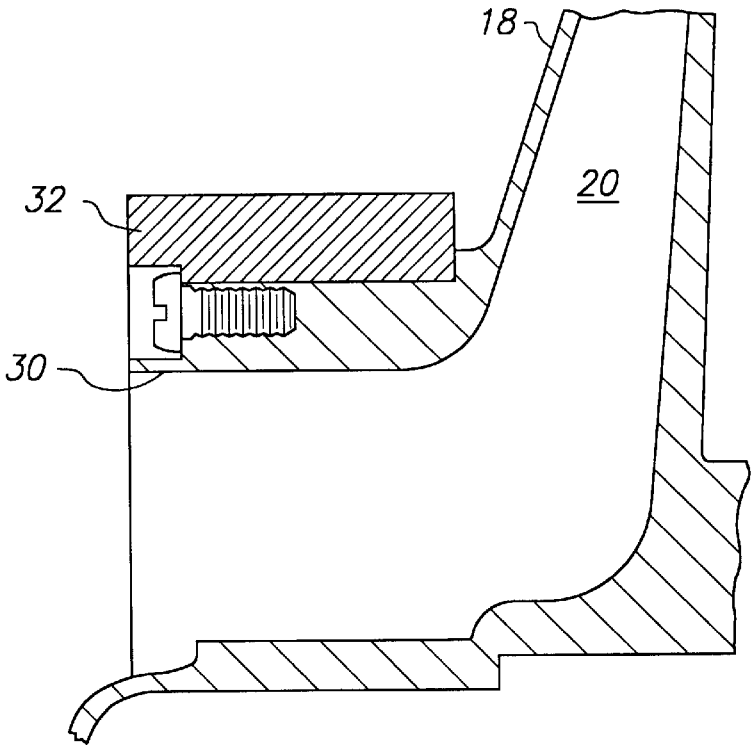
FIG. 2 is a cross-sectional view of a portion of an impeller illustrating one of three screw connections for attaching a wear ring to the outer diameter of an impeller.
Figure 5A:
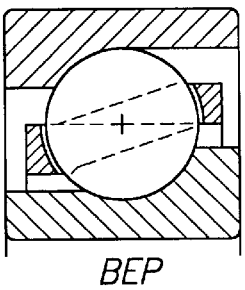
FIGS. 5A, 5B, 5C and 5D illustrates in cross-section four different thrust loadings of ball bearings as used in centrifugal pumps.
Figure 5B:
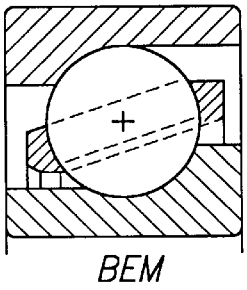
Figure 5C:
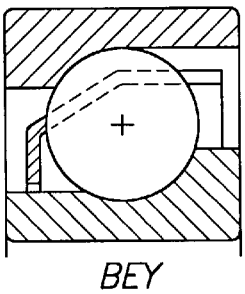
Figure 5D:
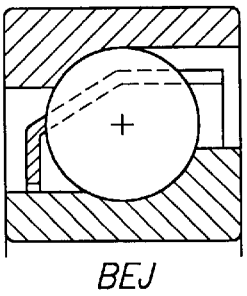

As shown in FIG. 1, wear ring 32 is indicated to be of the shrink-on type wherein the PEEK ring is shrunk into the casing wall. FIG. 2 illustrates shrink-on of a wear ring on the outer surface of impeller inlet end 30.

In accordance with this invention, design and installation of an impeller wear ring for a shrink-on-fit is as follows. The first step of this procedure requires determination of a cold interference fit and running clearance for PEEK (Xytrex 451 or equal) impeller wear rings in a centrifugal pump. The procedure uses several variable, examples which are given below. A separate procedure is used for determining fits and clearances for PEEK casing wear rings. An example is included to illustrate the procedure.

Accordingly, the following information must be known to determine PEEK impeller ring dimensions:

A. Casing ring material

B. Impeller material

C. Maximum operating temperature

1. Determine the Operating Temperature Limit for PEEK impeller rings from Table 1 below. If the maximum operating temperature would exceeds the listed limits, the pump is not a candidate for PEEK impeller rings.

TABLE 1

TEMPERATURE LIMITS FOR PEEK IMPELLER WEAR RINGS

| IMPELLER MATERIAL | OPERATING TEMPERATURE LIMIT (°F.) |
|---|---|
| GRAY CAST IRON | 200 |
| 12 CR STAINLESS STEEL | 200 |
| HASTELLOY B | 200 |

TABLE 1-continued

TEMPERATURE LIMITS FOR PEEK IMPELLER WEAR RINGS

| IMPELLER MATERIAL | OPERATING TEMPERATURE LIMIT (°F.) |
|---|---|
| HASTELLOY C | 205 |
| MALLEABLE/DUCTILE CAST IRON | 210 |
| CARBON STEEL | 210 |
| MONEL | 220 |
| NICKEL ALUMINUM BRONZE | 225 |
| ALLOY 20 | 225 |
| 18 CR-8 NI STAINLESS STEEL | 235 |
| NI-RESIST | 245 |
| BRASS/BRONZE | 245 |

Note:
Interference fits are based on .004"/inch of diameter initial and .002"/inch of diameter at maximum temperature.)

2. Measure the Cold (ambient temperature) Casing Ring ID (inner diameter). Skim cut to clean-up dimension prior to measuring if necessary.

3. Determine the Hot Casing Ring ID. Refer to Table 2 to find the value that corresponds to the casing ring material. Calculate, as in Table 3, the maximum operating temperature and nominal casing ring size. Add the number to the Cold Casing ID determined in Step 2. This is the Hot Casing Ring ID.

The following materials illustrate commonly used materials in centrifugal pump casings.

TABLE 2

| MATERIAL | THERMAL EXPANSION COEFFICIENT ($\times 10^{-6}$/°F.)* |
|---|---|
| Malleable/Ductile Cast Iron | 7.0 |
| Gray Cast Iron | 6.2 |
| Ni-Resist (≦22% Ni) | 10.5 |
| Carbon Steel | 7.1 |
| Brass/Bronze | 9.8 to 11.8 |
| Ni-Al Bronze | 9.0 |
| 12 Cr Stainless Steel | 6.4 |
| 18 Cr-8 Ni Stainless Steel | 9.6 |
| Alloy 20 | 8.8 |
| Hastelloy B | 6.2 |
| Hastelloy C | 6.8 |
| Monel | 8.3 |

*Thermal expansion values have been averaged over the temperature range from 70° F. to 450° F.

Specific examples of such thermal expansion values for different diameter of pump casings at 350° F. are set forth in Table 3.

Tables of wear ring diameters and casing thermal expansion may be calculated from the above values and proposed operating temperatures.

Following is an illustration of values for wear rings of 6", 12" and 18" diameters at 350° F. for each of the common casing materials listed in Table 2.

TABLE 3

| OP TEMP | 6 INCH | 12 INCH | 18 INCH |
|---|---|---|---|
| THERMAL EXPANSION FOR CARBON STEEL AND MALLEABLE/DUCTILE | | | |
| 350 | 0.012 | 0.024 | 0.036 |

TABLE 3-continued

| OP TEMP | 6 INCH | 12 INCH | 18 INCH |
|---|---|---|---|
| THERMAL EXPANSION FOR GRAY CAST IRON AND HASTELLOY B | | | |
| 350 | 0.010 | 0.021 | 0.031 |
| THERMAL EXPANSION FOR NI-RESIST (<22% Ni), AND BRASS/BRONZE | | | |
| 350 | 0.018 | 0.035 | 0.053 |
| THERMAL EXPANSION FOR NICKEL ALUMINUM BRONZE | | | |
| 350 | 0.015 | 0.030 | 0.045 |
| THERMAL EXPANSION FOR 12 Cr STAINLESS STEEL (400 SERIES) | | | |
| 350 | 0.011 | 0.022 | 0.032 |
| THERMAL EXPANSION FOR 18 Cr-8 Ni STAINLESS STEEL (200 SERIES) | | | |
| 350 | 0.016 | 0.032 | 0.048 |
| THERMAL EXPANSION FOR ALLOY 20 | | | |
| 350 | 0.015 | 0.030 | 0.044 |
| THERMAL EXPANSION FOR HASTELLOY C | | | |
| 350 | 0.011 | 0.023 | 0.034 |
| THERMAL EXPANSION FOR MONEL | | | |
| 350 | 0.014 | 0.028 | 0.042 |

4. Determine the Hot Diametral Running Clearance. Referring to Table 4 below, find the "PEEK Clearance" for the nominal casing ring ID at the maximum operating temperature. This is the Hot Diametral Running Clearance.

TABLE 4

HOT DIAMETRAL WEAR RING RUNNING CLEARANCE (For PEEK wear rings)

| NOMINAL WEAR RING DIAMETER (INCHES) | | RUNNING CLEARANCE |
|---|---|---|
| FROM | TO | (INCHES) |
| 2.000 | 2.999 | 0.006 |
| 3.000 | 3.999 | 0.007 |
| 4.000 | 4.999 | 0.008 |
| 5.000 | 6.999 | 0.009 |
| 7.000 | 8.999 | 0.010 |
| 9.000 | 10.999 | 0.011 |
| 11.000 | 12.999 | 0.012 |
| 13.000 | 14.999 | 0.013 |
| 15.000 | 16.999 | 0.014 |
| 17.000 | 18.999 | 0.015 |
| 19.000 | 20.999 | 0.016 |
| 21.000 | 22.999 | 0.017 |
| 23.000 | 24.999 | 0.018 |
| 25.000 | 26.999 | 0.019 |

5. Determine the Hot PEEK Ring OD (outer diameter). Subtract the Hot Diametral Running Clearance determined in Step 4 from the Hot Casing Ring ID determined in Step 3. This is the Hot PEEK Ring OD.
6. Skim-cut the impeller hub. Measure the Cold Impeller OD.
7. Determine the Hot Casing OD. Refer to Table 2 to find the value that corresponds to the impeller material. Calculate, as in Table 3, for the maximum operating temperature and nominal impeller hub size. Add the number to the Cold Impeller OD determined in step 6. This is the Hot Impeller OD.
8. Determine the Hot PEEK Ring ID. Since the PEEK ring will be installed on the impeller hub, the Hot PEEK Ring ID is the same dimension as the Hot Impeller OD determined in Step 7.
9. Determine the Cold PEEK Ring Interference. The cold interference fit is 0.004 inches/inch of diameter. Use the following equation to calculate the interference.

$$\text{Cold PEEK Ring Interference} = 0.004 \times \text{Cold Impeller OD} \qquad \text{Eq. - 1}$$

The Cold Impeller OD was determined in Step 6.

10. Determine the Cold PEEK Ring ID before installation on the impeller. Use the following equation to calculate the Cold Peek Ring ID.

$$\text{Cold PEEK Ring ID} = (\text{Cold Impeller OD}) - (\text{Cold PEEK Ring Interference}) \qquad \text{Eq. - 2}$$

The Cold Impeller OD and Cold PEEK Ring Interference were determined in Steps 6 an 9.

11. Determine the PEEK Ring Wall Thickness. Use the following equation.

$$\text{PEEK Wall} = \frac{(\text{Hot PEEK Ring } OD) - (\text{Hot PEEK Ring } ID)}{2} \qquad \text{Eq. - 3}$$

The Hot PEEK Ring OD and Hot PEEK Ring ID were determined in Steps 5 and 8.

12. Determine the PEEK Expansion Factor for calculating the Cold PEEK OD. Use the following equation.

$$\text{Expansion Factor} = (\text{Max Op Temp-70}) \times \text{PEEK Ring Wall Thickness} \times 2.94 \times 10^{-5} \qquad \text{Eq. - 4}$$

13. Determine the Cold PEEK Ring OD. Use the following equation.

$$\text{Cold PEEK Ring OD} = \text{Cold Impeller OD} + (2 \times \text{PEEK Ring Wall Thickness}) - (2 \times \text{Calculation Factor}) \qquad \text{Eq. - 5}$$

The Cold Impeller OD, Expansion Factor, and PEEK Ring Wall Thickness were determined in Steps 6, 12 and 11.

14. Machine PEEK wear ring length and ID (Step 9) from stock. Install onto impeller. Machine PEEK ring OD to dimension determined in Step 13. Secure PEEK wear ring onto impeller with three equally spaced axial screws as illustrated in FIG. 2.
15. Determine the Cold Diametral Running Clearance. The cold running clearance can be determined by subtracting the Cold PEEK Ring OD (Step 13) from the Cold Casing Ring ID (Step 2).

Following is an example of Impeller Wear Ring installation procedure, sample problem.

EXAMPLE 1

| | |
|---|---|
| A. Casing Ring Material | Cast Iron |
| B. Impeller Material | Steel |
| C. Maximum Operating Temperature | 180° F. |
| 1. Operating Temperature Limit (From Table 1) | 210° F. |
| 2. Cold Casing Ring ID (Measure) | 8.500 |
| 3. Hot Casing Ring ID (Step 2 + Number from Tables 2 and 3 (8.50 + .006 = 8.506) | 8.506 |
| 4. Hot Diametral Running Clearance (From Table 4) | 0.010 |

-continued

| | |
|---|---|
| 5. Hot PEEK Ring OD<br>(Step 3 − Step 4)<br>(8.506 − .010 = 8.496) | 8.496 |
| 6. Cold Impeller OD<br>(Measure) | 7.875 |
| 7. Hot Impeller OD<br>(Step 6 + Number from Tables 2 and 3)<br>(7.875 + .006 = 7.881) | 7.881 |
| 8. Hot PEEK Ring ID<br>(Same as Step 7) | 7.881 |
| 9. Cold PEEK Ring Interference<br>(0.004 × Step 6)<br>(0.004 × 7.875 = 0.032) | 0.032 |
| 10. Cold PEEK Ring ID<br>(Step 6 − Step 9)<br>(7.875 − .032 = 7.843) | 7.843 |
| 11. PEEK Ring Wall Thickness<br>(Step 5 − Step 8)/2<br>(8.496 − 7.881) ÷ 2 = .308 | 0.308 |
| 12. Expansion Factor<br>((Step C − 70) × 2.94 × $10^{-5}$ × Step 11)<br>(180 − 70) × 2.94 × $10^{-5}$ × .308 = .001 | 0.001 |
| 13. Cold PEEK Ring OD<br>((Step 6 + (2 × Step 11) − (2 × Step 12))<br>7.875 + (2 × .308) − (2 × .001) = 8.489 | 8.489 |
| 14. Machine PEEK Wear Ring | |
| 15. Cold Diametral Running Clearance<br>(Step 2 − Step 13)<br>8.500 − 8.489 | 0.011 |

Wear Ring Design and Installation—Casing Wear Ring Installation Procedure

This procedure sets forth the steps required to determine cold interference fits and running clearance for PEEK (Zytrex 451 or equal) casing wear rings in centrifugal pumps. The procedure uses several tables as indicated below. A separate procedure is used for determining fits and clearance given for PEEK impeller wear rings. A sample problem is included to illustrate the procedure.

When it is necessary to install a new metal wear ring on an impeller, the recommended material is 416 SS.

Procedure

The following information must be known to determine PEEK casing ring dimensions.

A. Casing material (casing ring material if the PEEK ring is to be installed in an existing metallic ring)

B. Impeller wear ring material (impeller material if there is not metal wear ring on the impeller)

C. Maximum operating temperature

1. Measure the cold (ambient temperature) impeller ring OD. Skim cut to clean-up dimension prior to measuring, if necessary.

2. Determine the hot (operating temperature) impeller ring OD. Refer to Table 2 to find the value that corresponds to the impeller ring material. Calculate as in Table 3 for the maximum operating temperature and nominal impeller wear ring diameter. Add the number to the cold impeller ring OD determined in Step 1. This is the hot impeller ring OD.

3. Determine the hot diametral running clearance. Referring again to Table 4, find the "PEEK Clearance" for the nominal impeller ring OD. This is the hot diametral running clearance.

4. Determine the Hot PEEK Ring ID. Add the hot diametral running clearance determined in Step 3 to the hot impeller ring OD determined in Step 2. This is the hot PEEK ring ID.

5. Bore the casing (or existing casing ring if the PEEK ring is to be installed in an existing metallic ring) to clean-up the dimension. Measure the cold casing ID.

6. Determine the Hot Casing ID. Refer to Table 2 to find the value that corresponds to the casing (or existing casing ring) material. Calculate as in Table 3 for the maximum operating temperature and nominal casing bore size. Add the number to the cold casing ID determined in Step 5. This is the hot casing ID.

7. Determine the Hot PEEK Ring OD. Since the PEEK ring will be installed in the casing, bore the hot PEEK ring OD the same dimension as the hot casing ID determined in Step 6.

8.Determine the Cold PEEK Ring Interference. The cold interference fit is 0.002" per inch of diameter. Use the following equation to calculate the interference.

$$\text{Cold PEEK Ring Interference} = 0.002 \times \text{Cold Casing ID} \qquad \text{Eq. - 6}$$

The Cold Casing ID was determined in Step 5.

9. Determine the Cold PEEK Ring OD before installation in the casing. Use the following equation to calculate the Cold Peek Ring OD.

$$\text{Cold PEEK Ring OD} = \text{Cold Casing ID} + \text{Cold PEEK Ring Interference} \qquad \text{Eq. - 7}$$

The Cold Casing ID and Cold PEEK Ring Interference were determined in Steps 5 and 8.

10. Determine the PEEK Ring Wall Thickness. Use the following equation.

$$\text{PEEK Wall} = \frac{(\text{Hot PEEK Ring } OD) - (\text{Hot PEEK Ring } ID)}{2} \qquad \text{Eq. - 8}$$

The Hot PEEK Ring OD and Hot PEEK Ring ID were determined in Steps 7 and 4.

11. Determine the Expansion Factor for calculating the Cold PEEK Ring ID. Use the following equation.

$$\text{Expansion Factor} = (\text{Max Op Temp-70}) \times \text{PEEK Ring Wall Thickness} \times 2.94 \times 10^{-5} \qquad \text{Eq. - 7}$$

The PEEK Ring Wall Thickness was determined in Step 10.

12. Determine the Cold PEEK Ring ID. Use the following equation.

$$\text{Cold PEEK Ring ID} = \text{Hot Casing ID} - (2 \times \text{Calculation Factor}) - (2 \times \text{PEEK Ring Wall Thickness}) \qquad \text{Eq. - 10}$$

The Hot Casing ID, Expansion Factor, and PEEK Ring Wall Thickness were determined in Steps 6, 11 and 10.

13. Machine PEEK wear ring length and OD (Step 9) from stock. Shrink fit into casing. Machine PEEK ring ID to dimension determined in Step 12.

14. Determine the Cold Diametral Running Clearance. The cold running clear can be determined by subtracting the cold impeller ring OD (Step 1) from the cold PEEK ring ID (Step 12).

The following is an example of Casing Wear Ring installation procedure, sample problem.

EXAMPLE II

| | | |
|---|---|---|
| A. | Casing (or Casing Ring) Material | Steel |
| B. | Impeller Ring Material | Cast Iron |
| C. | Maximum Operating Temperature | 400° F. |
| | 1. Cold Impeller Ring OD<br>Measure | 6.750 |
| | 2. Hot Impeller Ring OD<br>(Step 1 + number from Tables 2 and 3)<br>(6.750 + 0.14 = 6.764) | 6.764 |

EXAMPLE II-continued

| | | |
|---|---|---|
| 3. | Hot Running Diametral Clearance<br>(From Table 4) | 0.009 |
| 4. | Hot PEEK Ring ID<br>(Step 2 + Step 3)<br>(6.764 + .009 = 6.773) | 6.773 |
| 5. | Cold Casing ID<br>(Measure) | 7.375 |
| 6. | Hot Casing ID<br>(Step 5 + number from Tables 2 and 3)<br>(7.375 + .016 = 7.391) | 7.391 |
| 7. | Hot PEEK Ring OD<br>(Same as Step 6) | 7.391 |
| 8. | Cold PEEK Ring Interference<br>(0.002 × Step 5)<br>(0.002 × 7.375 = .015) | 0.015 |
| 9. | Cold PEEK Ring OD<br>(Step 5 − Step 8)<br>(7.375 + 0.15 = 7.390) | 7.390 |
| 10. | PEEK Ring Wall Thickness<br>(Step 7 − Step 4)/2<br>(7.391 − 6.773) ÷ 2 = .309) | 0.309 |
| 11. | Expansion Factor<br>((Step C − 70) × 2.94 × $10^{-5}$ × Step 10)<br>(400 − 70) × 2.94 × $10^{-5}$ × .309 = .003 | 0.003 |
| 12. | Cold PEEK Ring OD<br>((Step 6 + (2 × Step 10) − (2 × Step 11))<br>7.391 + (2 × .309) − (2 × .003) = 6.767 | 6.767 |
| 13. | Machine PEEK Wear Ring | |
| 14. | Cold Diametral Running Clearance<br>(Step 12 − Step 1)<br>6.767 − 6.750 = .017 | 0.017 |

BALANCE HOLE PLUGGING

Where plugging balance holes is desirable for reasons discussed below, such desirability may be evaluated as follows. Single stage, single suction overhung centrifugal pump designers have used impeller balance holes for decades to control thrust bearing loads. These holes equalize the pressure between the suction eye and backside of the impeller with the help of a rear wear ring. Their primary benefits are:

Reduction of high axial thrust loads in certain pumps that would otherwise require unrealistically large bearings. These tend to be the pumps with the higher heads, larger impellers, and lower suction pressures.

Reduction of stuffing box pressure. This was much more of a benefit in the days of packing than it is now with mechanical seals.

Balancing holes also have significant disadvantages for the following reasons. Leakage through the balancing holes adds to the pump's energy usage. Low stuffing box pressure is detrimental to mechanical seals in flashing services. This is particularly true for many LPG and ammonia pumps. But it also applies to applications taking suction from flash drums, reboiler, columns and other sources where the fluid is near its boiling point.

Like any wear ring, the back wear ring has a running clearance which is subject to wear and seizure, and must be periodically maintained. They can be too effective and either unload or reverse the thrust load. This tends to cause ball skidding which shortens the life of an angular contact bearing. They create a flow disturbance in the impeller eye which can contribute to marginal NPSH or low flow recirculation problems.

There are many refinery pumps which have balancing holes and back wear rings, but they do not need them, based on:

1. Calculating a pump's thrust load and determining if it is eligible for the conversion.

2. Selecting the best thrust bearing.

Plugging balance holes will reduce pumping energy consumption, lower maintenance costs long-term and improve reliability. The implementation cost is minor when done during a normal pump overhaul.

This procedure only applies to single-stage, single-suction, overhung, horizontal centrifugal pumps. It does not apply to double suction, open impeller, vertical, or multi-stage pumps since they do not normally have impeller balancing holes.

Figure 3:
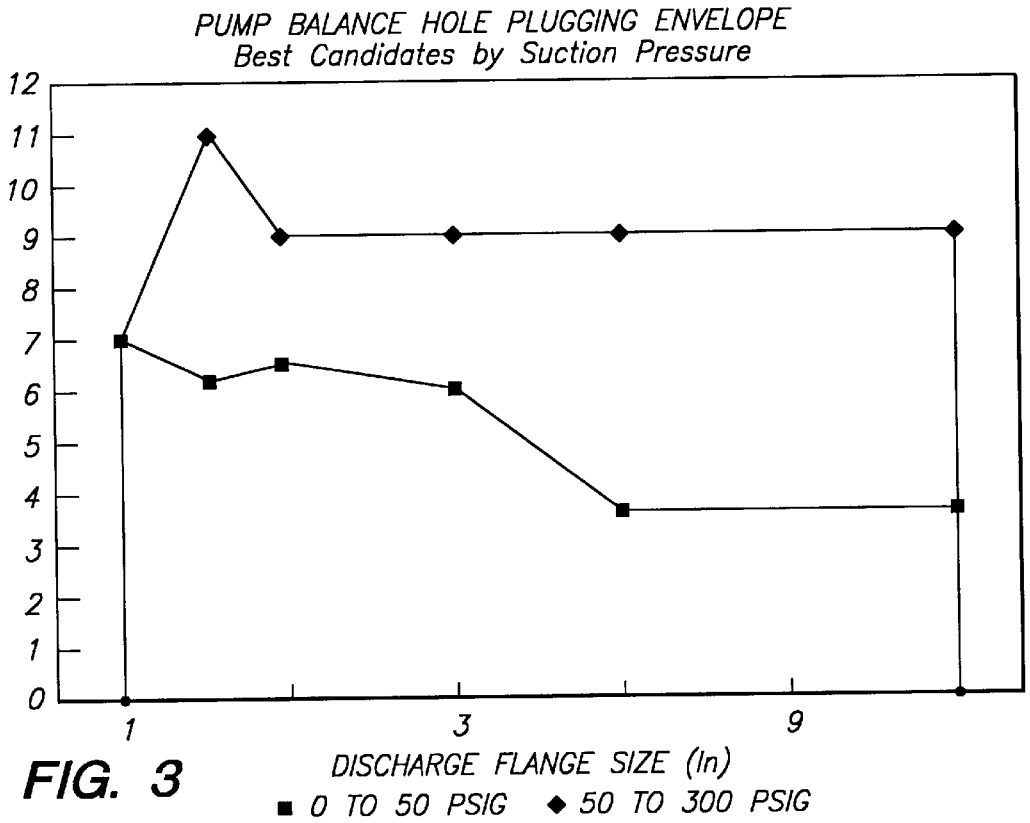
FIGS. 3 and 4 are screening charts for a 3600 RPM pump useful in determining the suitability for plugging the balance hole for different operating temperature and pressure conditions imposed by application of loads on a centrifugal pump.
Figure 4:
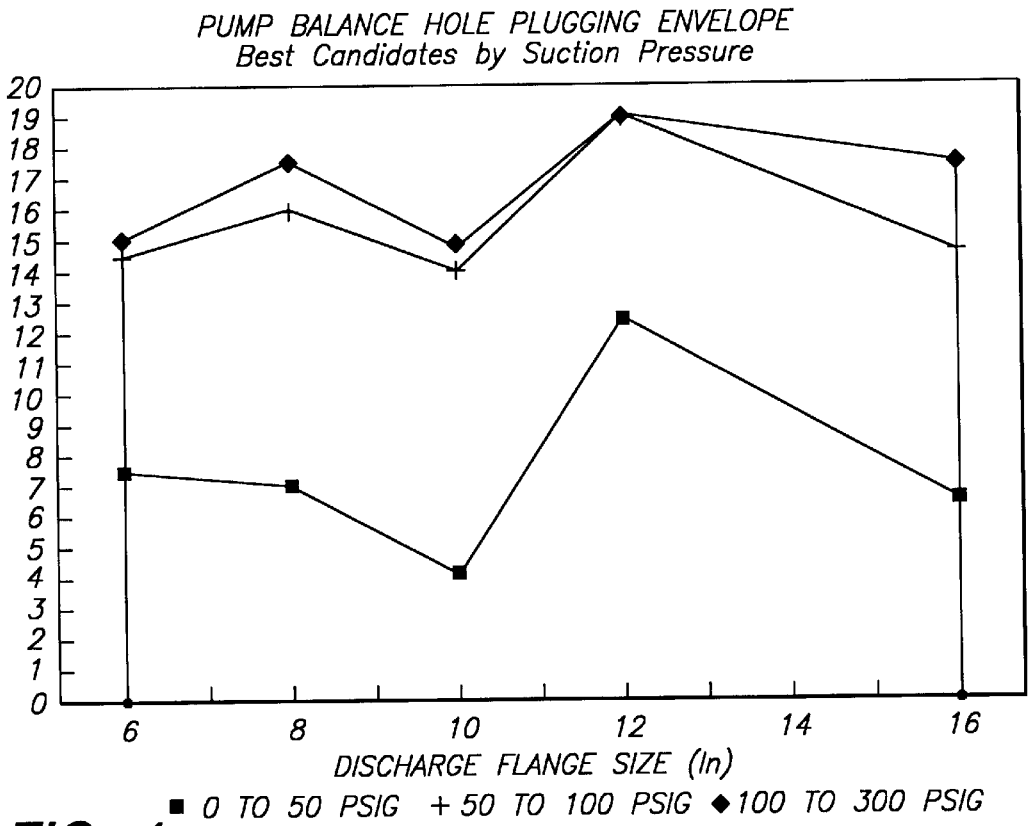
Figure 6A:
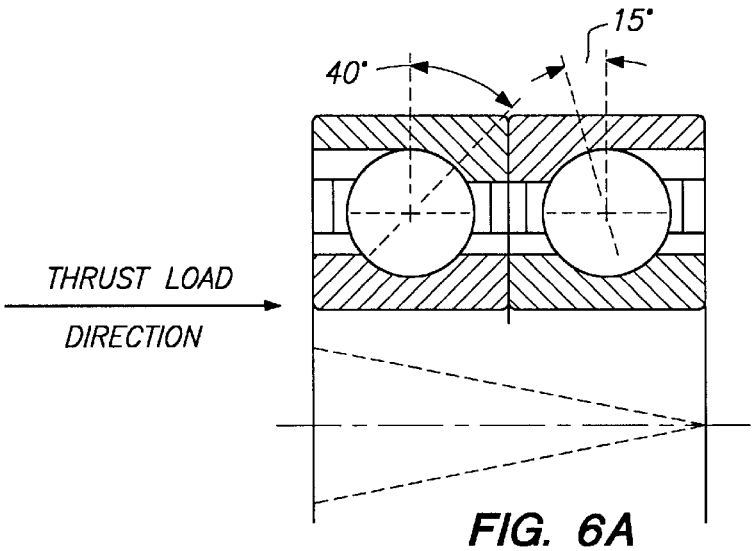
FIGS. 6A, 6B and 7 illustrate forces on ball bearings as described in EXAMPLE III.
Figure 6B:
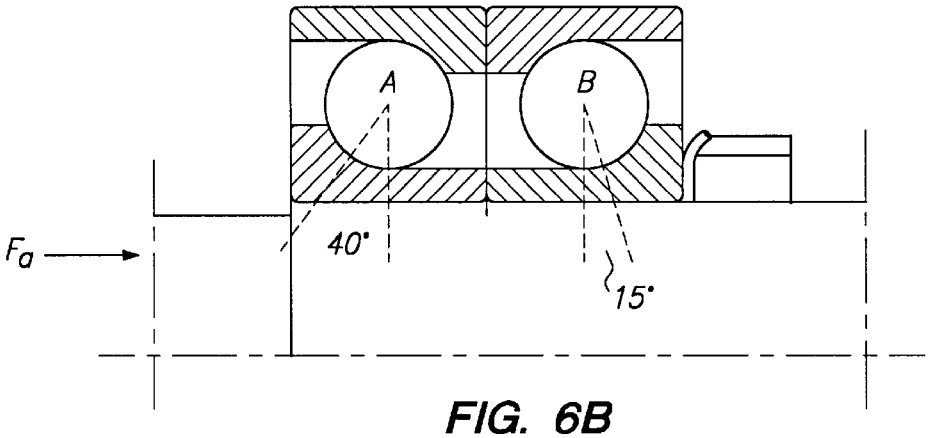
Figure 7:
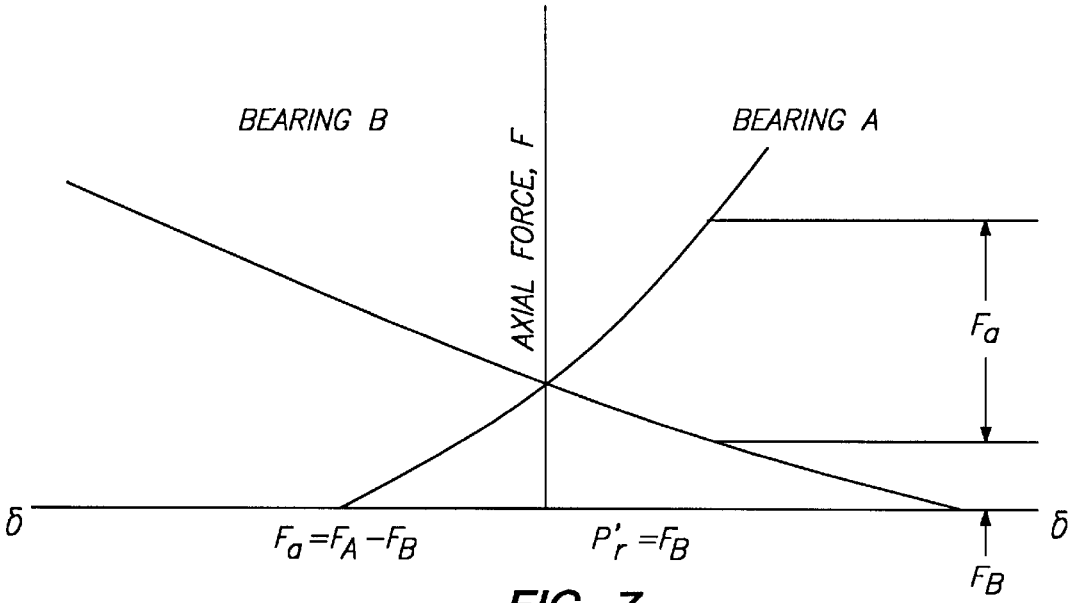

The thrust bearing load on the pump should be evaluated before plugging balancing holes and removing the back wear ring. The procedure is as follows:

1. Select the graph for the particular pump speed, 3600 or 1800 rpms, in FIGS. 3 and 4.

2. Estimate the pumped fluid specific gravity (usually between 0.5 and 1.0) and multiply it by the maximum impeller diameter. Plot this value versus the discharge flange size.

3. Identify which curve applies to the pump based on normal suction pressure.

4. If the plotted point is below the appropriate curve, then the pump is a good candidate for balance hole plugging. If it is above the curve, a conversion would probably overload the thrust bearing.

The higher priority pumps to plug include those with one or more of the following features: (1) those with mechanical seal reliability problems primarily due to a flashing service, of which LPG pumps are likely to be the best candidates; and (2) pumps with prematurely failing thrust bearings due to light or reversing loads, and pumps of 200 horsepower and larger drivers.

Thrust Load Calculation Procedure

The Data sheet Example IV and Calculation sheet Example IV for Plugging Impeller Balance Holes, below, are useful guides for evaluating individual pumps. They provide the necessary information for plugging and back wear ring removal decisions.

The evaluation steps are:

1. Complete the "Data Sheet for Plugging Impeller Balance Holes". The term "Normal" under pump performance describes the typical operating pressures. The Minimum Suction Pressure is that which the pump experiences for any time longer than a few hours. Shutoff discharge pressure is the minimum suction pressure plus the pressure differential that the pump can produce at shutoff.

2. Calculate the Normal Thrust Load with the formula provided on the "Calculation Sheet for Plugging Impeller Balance Holes" and record the answer on the line provided.

3. Find the Maximum Bearing Load and Minimum Bearing Load in Table 5, below.

4. Calculate and record the Normal Safety Factor. If the value is greater than or equal to 1.0, continue with the evaluation. If it is less than 1.0, chose from the following options:

a) Disqualify the pump as a hole plugging candidate.

b) Accept the possibility of reduced bearing life and continue.

c) Investigate alternate bearing configurations with acceptable load carrying capacity. These may require a new bearing bracket.

5. Calculate and record the Extreme Thrust Load and the Extreme Safety Factor. These values provide information one must use in the final hole plugging decision. If the Extreme Safety Factor is less than 0.5 and it occurs frequently, consider the options listed in Step 4.

6. The rare instances with thrust below the Minimum Bearing Loading are beyond the scope of this best practice (best mode of this invention). They typically only occur on smaller pumps with high suction pressure and low differential. Evaluate each one as a special case.

The most popular thrust bearings on horizontal single stage pumps are 40° angular contact back-to-back arrangements. These provide high thrust carrying capacity in both directions. Many pumps with balance holes and back wear rings may shuttle the load back and forth, reacting to varying suction and differential pressures. As a result, an unloaded or lightly loaded bearing can suffer ball skidding wear and premature failure.

Removing the impeller balance holes usually assures thrust bearing loading towards the impeller. The unloaded angular contact bearing does not need to be as highly rated as the active one. Therefore the best practice (best mode of this invention) is to install MRC series 8000 PumpPac bearing sets. They use a 40° contact bearing in the active direction and 15° on the inactive side. The 15° bearing has a tight internal clearance and suffers much less ball skidding wear while running unloaded. But, it can still handle intermittent reverse loads during start-up and transient conditions. An excerpt from the SKF application handbook "Bearings in Centrifugal Pumps" is set forth in Exhibit III below.

Mechanical Seal Considerations

The mechanical seal must be considered when choosing to plug the impeller balance holes. This action will raise the seal cavity pressure to near discharge, therefore rendering a Plan 11 Flush plan inoperable.

The installed seal should be reviewed and a determination made as to whether it is rated for the higher pressure. A careful review of the PV should be made, if unsure of the pressure rating check with the seal manufacturer.

The most common seal flush plan is an API-Plan 11 (discharge through an orifice to the seal), it can easily be converted to a Plan 13 (Seal chamber through an orifice back to suction). If any other Flush plan is used, a thorough study should be made to insure adequate cooling and lubrication to the seal faces.

DATA SHEET FOR PLUGGING IMPELLER BALANCE HOLES

| | |
|---|---|
| Pump Identification | |
| Plant | |
| Equipment No. | |
| Pump Manufacturer | |
| Model No. | |
| Dimensions | |
| Impeller Diameter (inches) | |
| Front Wear Ring Diameter (inches) | $D_{WR}$ |
| Seal Sleeve Diameter (inches) | $D_{SS}$ |
| Thrust Bearing | |
| Bore Diameter (mm) | |
| Model No. | |
| Pump Performance | |
| Speed (rpm) | |
| Normal Suction Pressure (psig) | |
| Normal Discharge Pressure (psig) | |
| Minimum Suction Pressure (psig) | |
| Shutoff Discharge Pressure (psig) | |

CALCULATION SHEET FOR PLUGGING IMPELLER BALANCE HOLES

Normal Conditions

Normal Thrust Load = $.785 \times [D_{WR}^2 \times (P_D - P_X) - (P_D \times D_{SS}^2)$
Normal Thrust Load =_____lbs
Maximum Bearing Load =_____lbs (from chart)
Minimum Bearing Load = _____lbs (from chart)
Normal Safety Factor = (Maximum Bearing Load)/(Normal Thrust Load)
Normal Safety Factor =_____

Extreme Conditions

Extreme Thrust
Load = $.785 \times [D_{WR}^2 \times P_{D\text{-}MAX} - P_{S\text{-}MIN}) - (P_{DMAX} \times D_{SS}^2)$
Extreme Thrust Load =_____lbs
Extreme Safety Factor = (Maximum Bearing Load)/(Extreme Thrust Load)
Extreme Safety Factor = _____

Note:
Positive thrust is defined as toward the suction and away from the coupling.

EXAMPLE III

MRC PUMPAC BEARINGS

The MRC series 8000 PumpPac bearings are a matched set of two angular contact ball bearings, one having a 40° contact angle and the other a 15° contact angle. The bearings are produced as standard with machined brass inner ring land riding cages, and ISO class 6 (ANSI/AFBMA CLASS ABEC 3) tolerances.

The PumPac bearing set is to be mounted in the pump with the 40° bearing supporting the applied axial load as the active bearing. The use of the 15° bearing provides several advantages:

—low sensitivity to gyratory motion and low requirement for axial load

—lower sensitivity to mounting conditions resulting in lower mounted preload

—greater initial preload deflection resulting in greater residual preload with applied axial loads —higher radial stiffness.

The benefit of the greater initial preload deflection allows greater axial load to be applied to a PumPac bearing set, as compared with two 40° bearings before the residual load on the inactive 15° bearing is reduced to zero. In principle, the unload factor X for a PumPac bearing set is 13. Therefore the PumPac bearing set can support approximately three times greater axial load than two 40° bearings before unloading the 15° bearing.

The result of these features is a reduced bearing operating temperature, documented in some cases to be as great as 10° C. (18° F.).

The PumPac bearing set must be mounted in the pumps so that the 40° bearing supports the applied axial load as the active bearing. The outer rings of the two bearings are scribed together with a V arrow. This V arrow is to be oriented in the direction of the applied axial load.

Caution should be taken when using the PumPac. The PumPac bearing set should not be used in pumps where the direction of axial load is unknown. Operation with axial load in the direction of the 15° bearing can result in bearing failure. It is recommended that the PumPac bearing set be used in applications where the axial load is high in one direction and does not change direction during operation. The PumPac bearing set can accept momentary reversals in axial load, such as those that occur during pump start-up and stoppage, etc.

The inner ring land riding cage of the PumPac set requires special attention when it is grease lubricated. An initial charge of grease must be specifically injected between the cage and inner ring at assembly to ensure satisfactory lubrication.

The PumPac bearing set with matched 40° and 15° bearings does not meet the requirements of the API 610 Standard. This Standard requires the use of two 40° single row angular contact ball bearings for the thrust bearing. At the option of the pump purchaser, the requirements of the API Standard can be waved to allow the use of the PumPac bearing set.

TABLE 5

MRC PUMPPAC THRUST LOAD LIMITS
(Based on a 25,000 Hour L-10 Bearing life)

| | | 1800 RPM | | 3600 RPM | |
|---|---|---|---|---|---|
| Bore Diam (min) | MRC Bearing No. | Maximum Bearing Load (lbs) | Minimum Bearing Load (lbs) | Maximum Bearing Load (lbs) | Minimum Bearing Load (lbs) |
| 40 | 8308 | 1713 | 13 | 1357 | 52 |
| 45 | 8309 | 2154 | 21 | 1707 | 85 |
| 50 | 8310 | 2469 | 26 | 1956 | 106 |
| 55 | 8311 | 2860 | 42 | 2265 | 167 |
| 60 | 8312 | 3225 | 56 | 2555 | 225 |
| 65 | 8313 | 3591 | 83 | 2844 | 333 |
| 70 | 8314 | 4195 | 105 | 3323 | 421 |
| 75 | 8315 | 4498 | 133 | 3563 | 532 |
| 80 | 8316 | 4876 | 157 | 3862 | 629 |
| 85 | 8317 | 5266 | 196 | 4172 | 785 |
| 90 | 8318 | 5632 | 242 | 4461 | 968 |
| 95 | 8319 | 5997 | 295 | 4750 | 1182 |

Machining PEEK

An essential step in preparing PEEK for use in the foregoing procedures requires precise machining of PEEK. PEEK material is not difficult to machine provided the proper tools are used. Rough machining can be done with a carbide tool. A normal high speed tool is not hard enough even for rough machining. Finish cuts are desirably made with a diamond tool such as the Kennemetal Polycrystalline Diamond DK 100 in AR8 form. Attempts to create finished dimensions with other than a diamond tool usually result in a tapered surface.

Normal speeds and feeds can be used and cooling is only necessary above approximately ten inch diameter pieces. Raw material furnished by a supplier such as ECG Corporation (11718 McGallion, P.O. Box 16080, Houston, Tex. 77222) can be purchased with a wooden chucking stub bonded to the PEEK material. ECG can also supply the adhesive to glue PEEK pieces to chucking stubs in the user's shop. The adhesive cures in about 24 hours at room temperature but curing can be accelerated by raising the temperature. At 250° F., the curing time is 5 minutes. The adhesive, Fluoroset Epoxy A Adhesive, can be obtained from ECG with instructions for its use.

What is claimed is:

1. A method for improving the efficiency of a centrifugal pump by decreasing a clearance of a wear ring between an inner diameter of a plenum chamber of said centrifugal pulp and an outer diameter of an impeller of said pump, wherein said impeller rotates in said plenum chamber formed by a surrounding casing, said casing having an intake eye for flow of fluid into said plenum chamber, and the wear ring axially aligned between an inner diameter of an inlet portion of said plenum chamber and the outer diameter of said impeller to reduce loss of fluid pressure between an output from said plenum chamber and said intake eye, which method comprises the steps of:

A) determining a maximum operating temperature of fluid to be pumped by said centrifugal pump;

B) determining thermal coefficients of expansion of materials forming each of said plenum chamber, said impeller and said wear ring;

C) computing a total change of diameter of said casing, said impeller and said wear ring over a range of fluid operating temperatures of the fluid to be pumped from ambient conditions to said maximum operating temperature;

D) removing said inlet portion of said pump casing to expose at least an inlet side of said impeller;

E) removing said wear ring from said pump casing;

F) calculating an inner and an outer diameter of a substitute wear ring in accordance with the maximum operating temperature of the fluid being pumped and said coefficients of thermal expansion determined in step B to establish a differential expansion of the outer diameter of said impeller, the inner diameter of said plenum chamber and the inner and outer diameters of said wear ring; and G) forming a substitute wear ring of a thermoplastic material having thermal stability over a temperature range higher than the range of fluid operating temperatures of the fluid to be pumped, such that a running clearance of the substitute wear ring having inner and outer diameters is adequate to avoid contact between said impeller and said pump casing while said fluid is pumped at said range of fluid operating temperatures.

2. The method of claim 1 wherein said thermoplastic material is poly-ether-ether-ketone and said substitute wear ring is secured to said impeller for rotation therewith.

3. The method of claim 1 wherein said thermoplastic material is poly-ether-ether-ketone and said substitute wear ring is secured to said inner diameter of said inlet portion of said plenum chamber.

4. The method of claim 1 wherein said thermoplastic material of said wear ring is poly-ether-ether-ketone, and further comprising a step of calculating a change in diameter of each of said casing, said impeller and said wear ring for the range of fluid operating temperatures of the fluid to be pumped by said centrifugal pump from ambient temperature to said maximum operating temperature, and cutting the diameter of said substitute wear ring to attain a hot running clearance thereof not greater than 0.02 inches between said substitute wear ring diameter, and an opposed diametral surface of said pump.

5. The method of claim 1 wherein said substitute wear ring is poly-ether-ether-ketone and is secured to said inlet portion of said plenum chamber.

6. The method of claim 1 wherein said substitute wear ring is poly-ether-ether-ketone and is secured to a liquid entry face of said pump casing.

7. A method for improving the efficiency of a centrifugal pump operating over a selected temperature range of from zero to 600° F., said pump comprising a metal pump casing enclosing a rotatable metal impeller and at least one wear ring between said impeller and one side of said casing thereby forming a fluid intake portion, which method comprises:

A) calculating differential changes in diameter of each of said impeller, said at least one wear ring and said intake portion of said casing over said selected temperature range;

B) calculating said wear ring diameters at both ambient temperature and over said selected temperature range using coefficients of thermal expansion for each of the materials forming each of said impeller, said intake portion of said casing and said at least one wear ring to determine a required running clearance at a selected liquid operating temperature not exceeding 0.02 inches; and C) preforming a substitute wear ring formed of poly-ether-ether-ketone using the diameters determined in step B, thereby minimizing an annular space between an intake passage through an intake surface of said casing and an outer surface of said impeller.

8. The method of claim 7 wherein said substitute wear ring is bound to said outer surface of said impeller for rotation of said substitute wear ring with said impeller.

9. The method of claim 7 wherein said substitute wear ring is bound to said pump casing to support the outer diameter of said substitute wear ring against a rotatable surface of said impeller, thereby maintaining a minimum clearance between said substitute wear ring and said impeller.

10. The method of claim 7 wherein said centrifugal pump further comprises a pressure balance hole extending from a plenum chamber wherein the fluid pressure around said impeller is substantially greater than an intake pressure, and wherein after installation of said poly-ether-ether-ketone substitute wear ring said pressure balance hole is plugged.

11. A method for improving the efficiency of a centrifugal pump by minimizing a total running clearance between a wear ring and an opposite pump casing or a rotatable impeller during expansion from an ambient temperature to pump operating temperatures of a heated fluid, said centrifugal pump having the wear ring between an outer circumference of the rotatable impeller of said centrifugal pump and an inner surface of the pump casing surrounding said rotatable impeller and forming a fluid intake portion of said pump, which method comprises the steps of:

A) removing said fluid intake portion of said pump casing to expose said rotatable impeller of said pump and said wear ring;

B) calculating inner and outer diameters of said wear ring using radial differences in thermal expansion of poly-ether-ether-ketone from the ambient temperature to a selected pump operating temperature for fluid to be pumped;

C) calculating a thermal expansion of said pump casing and said impeller from the ambient temperature to said selected pump operating temperature for said fluid to be pumped;

D) forming an annular ring of poly-ether-ether-ketone having an inner diameter and an outer diameter calculated in steps B) and C), and adapting one of said wear ring diameters to be shrunk fitted to one of opposed faces of the inside diameter of said pump casing or the outer diameter of said pump impeller; and E) removing said wear ring from said impeller and said casing portions, and substituting therefore said annular ring of step D), thereby minimizing the total running clearance between said wear ring and the opposite pump casing or impeller while expanding from said ambient temperature to said pump operating temperatures of the heated fluid.

* * * * *